US010801799B2

(12) United States Patent
Hunsaker

(10) Patent No.: US 10,801,799 B2
(45) Date of Patent: Oct. 13, 2020

(54) MUZZLE LOADING RAMROD

(71) Applicant: James Perry Hunsaker, Higley, AZ (US)

(72) Inventor: James Perry Hunsaker, Higley, AZ (US)

( * ) Notice: Subject to any disclaimer, the term of this patent is extended or adjusted under 35 U.S.C. 154(b) by 0 days.

(21) Appl. No.: 16/393,254

(22) Filed: Apr. 24, 2019

(65) Prior Publication Data

US 2019/0331451 A1 Oct. 31, 2019

Related U.S. Application Data

(60) Provisional application No. 62/662,437, filed on Apr. 25, 2018.

(51) Int. Cl.
*F41A 29/02* (2006.01)
*F41C 9/08* (2006.01)

(52) U.S. Cl.
CPC ..... *F41A 29/02* (2013.01); *F41C 9/085* (2013.01)

(58) Field of Classification Search
CPC ..... F41A 29/00; F41A 29/02; F41A 29/04; F41C 9/08; F41C 9/085
See application file for complete search history.

(56) References Cited

U.S. PATENT DOCUMENTS 464,099 A 12/1891 Von Wehrstedt
602,937 A 4/1898 Egli
1,192,174 A 7/1916 Dvorak
1,237,056 A 6/1917 Kitchen
1,348,145 A 8/1920 Arden
1,556,494 A 10/1925 Cooper
1,665,988 A 4/1928 Smith
1,698,803 A * 1/1929 Petersen ..... F41A 29/02 403/78
2,616,109 A 11/1952 Gardner
2,637,060 A 5/1953 Cowan
2,737,676 A 3/1956 Pribis, Jr.
2,805,434 A * 9/1957 Hopkins ..... F41A 29/02 15/104.16
3,402,950 A 9/1968 Hertzberg
3,710,411 A 1/1973 Murguiondo
3,747,252 A 7/1973 Walker
3,813,802 A 6/1974 Di Prospero
4,010,565 A 3/1977 DiProspero
4,327,515 A 5/1982 Kuryn
4,407,086 A 10/1983 Hasselmann
4,414,770 A 11/1983 Brinton, Sr.
4,550,517 A * 11/1985 Mansfield ..... F41C 9/085 42/90
4,843,747 A 7/1989 Echeberria
4,875,303 A 10/1989 DeWeert et al.
4,912,868 A 4/1990 Thompson
(Continued)

*Primary Examiner* — Benjamin P Lee
(74) *Attorney, Agent, or Firm* — Schmeiser, Olsen & Watts LLP

(57) ABSTRACT

A ramrod for a muzzleloader is provided. The ramrod includes a shaft having a knob releasably and rotatably coupled to one end thereof. The knob may have a central bore therein, and the shaft may be inserted into the central bore. The knob may include an internal bearing, wherein the shaft rotates with respect to the knob by operation of the internal bearing in response to rotation of a bullet during loading a rifle with the bullet, wadding, and a propellant charge.

7 Claims, 2 Drawing Sheets

(56) References Cited

U.S. PATENT DOCUMENTS 4,962,607 A * 10/1990 Baldwin ..... F41A 29/02 15/104.165
5,075,998 A * 12/1991 Selleck ..... F41A 29/02 15/104.2
5,127,179 A 7/1992 Marsh
5,651,207 A * 7/1997 Knight ..... F41A 29/00 15/104.165
5,836,099 A * 11/1998 Pace ..... F41A 29/02 42/95
5,934,000 A 8/1999 Hayes, Sr.
6,145,235 A 11/2000 Emerson et al.
6,336,284 B1 * 1/2002 Rotell, III ..... F41C 9/085 42/90
RE38,247 E 9/2003 Wickser, Jr.
6,637,143 B1 10/2003 Wykle
6,981,345 B1 * 1/2006 Gunn ..... F41A 29/02 42/90
7,441,363 B1 10/2008 Black et al.
7,836,624 B1 * 11/2010 Pennington ..... F41A 29/02 42/95
8,991,089 B2 3/2015 Hunsaker
9,279,637 B2 * 3/2016 Hunsaker ..... F41C 9/085
9,500,437 B2 * 11/2016 Grazioplene ..... F41C 9/08
9,505,039 B1 * 11/2016 Green ..... B08B 1/003
9,587,904 B2 3/2017 Hunsaker
2003/0233779 A1 * 12/2003 Graves ..... F41A 29/02 42/90
2004/0244260 A1 * 12/2004 Kanyuck ..... F41C 9/085 42/90
2005/0279003 A1 * 12/2005 Gunn ..... F41A 29/02 42/90
2006/0005446 A1 1/2006 Lee et al.
2006/0010753 A1 * 1/2006 Buie ..... F41A 29/02 42/95
2006/0277811 A1 * 12/2006 Peterson ..... F41A 29/02 42/95
2011/0209378 A1 * 9/2011 Johnston ..... F41C 9/085 42/90
2011/0302818 A1 12/2011 Samaras et al.
2013/0047484 A1 * 2/2013 Wickser, Jr. ..... F41A 17/44 42/95
2013/0061507 A1 * 3/2013 Hunsaker ..... F41C 9/085 42/90
2013/0091752 A1 4/2013 Ervin
2013/0104442 A1 5/2013 Hancharick
2013/0283658 A1 10/2013 Buie, II
2014/0290112 A1 10/2014 Horne
2015/0047245 A1 * 2/2015 Ervin ..... F41A 9/375 42/90
2016/0202015 A1 * 7/2016 Poehlman ..... F41A 29/02 42/90

* cited by examiner

MUZZLE LOADING RAMROD

CROSS REFERENCE TO RELATED APPLICATION[S]

This application claims priority to U.S. Provisional patent application entitled "MUZZLE LOADING RAMROD," Ser. No. 62/662,437, filed Apr. 25, 2018, the disclosure of which is hereby incorporated entirely herein by reference.

BACKGROUND

Technical Field

This disclosure relates generally to muzzle-loading guns and more particularly to a new and improved ramrod for use with muzzleloaders.

State of the Art

From cannons to small pistols, muzzle-loading weapons have been in existence for centuries. Generally, a "muzzleloader" is any weapon into which the propellant charge, i.e., gunpowder, and the projectile, i.e., bullet, that is intended to be discharged from the weapon, are loaded into the weapon by way of the muzzle, the muzzle being the forward, open end of the weapon's barrel. A muzzleloader may typically be loaded by inserting a measured amount of propellant charge into the muzzle, followed by the insertion of the projectile into the muzzle. In many cases, wadding, i.e., a piece of fabric, felt, cloth, or card, is placed around the projectile, or at least behind the projectile, such that when the projectile is inserted into the barrel the wadding is positioned between the propellant charge and projectile. Because the projectile and the wadding are generally tight-fitting within the bore of the barrel, a ramrod is utilized to drive the wadding and projectile down the barrel to ensure they are firmly seated on the propellant charge.

SUMMARY

The present disclosure relates to muzzle-loading firearms, and in particular to a new and improved ramrod that facilitates the efficient and safe loading of a projectile into the muzzleloader.

An embodiment includes a ramrod for a muzzleloader, the ramrod comprising a shaft having a first end and a second end; and a knob releasably and rotatably coupled to the first end of the shaft, the knob comprising an internal bearing, wherein the shaft rotates with respect to the knob by operation of the internal bearing in response to rotation of a bullet during loading a rifle with the bullet, wadding, and a propellant charge.

The foregoing and other features and advantages of the present disclosure will be apparent from the following more detailed description of the particular embodiments of the disclosure, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

As discussed above, embodiments of the present disclosure relate to muzzle-loading firearms, and in particular to a new and improved device that facilitates the efficient and safe loading of a projectile into the muzzleloader, while at the same time reduces the noise generated by the movement of the ramrod during transport of the muzzleloader.

Figure 1:
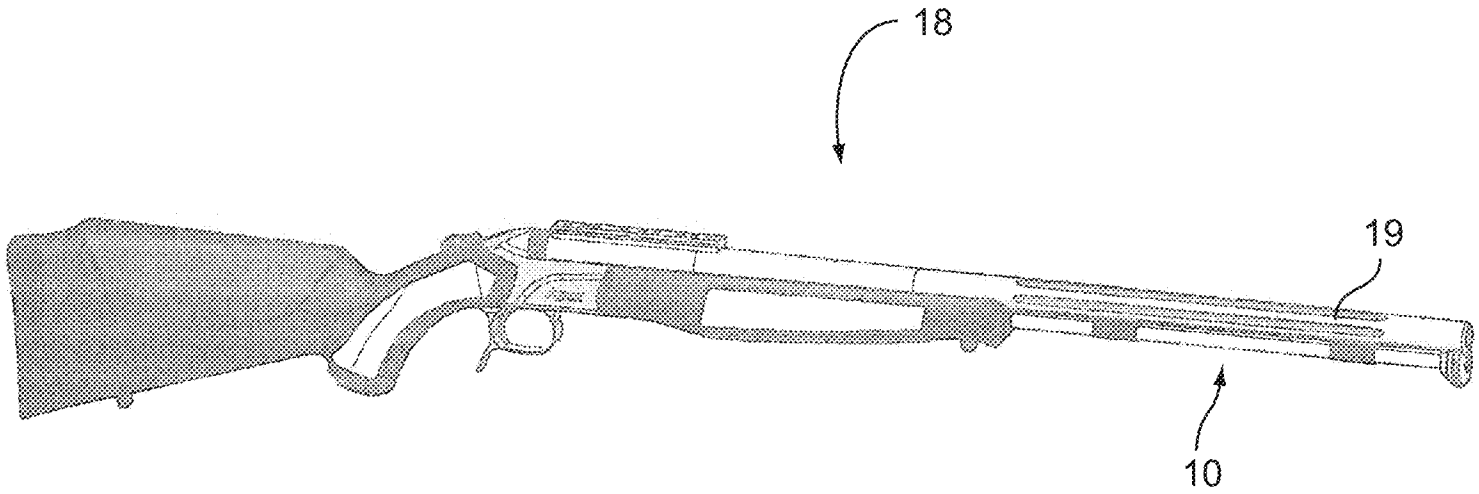
FIG. 1 is a side perspective view of the ramrod stored on the weapon in accordance with an embodiment.
Figure 2:
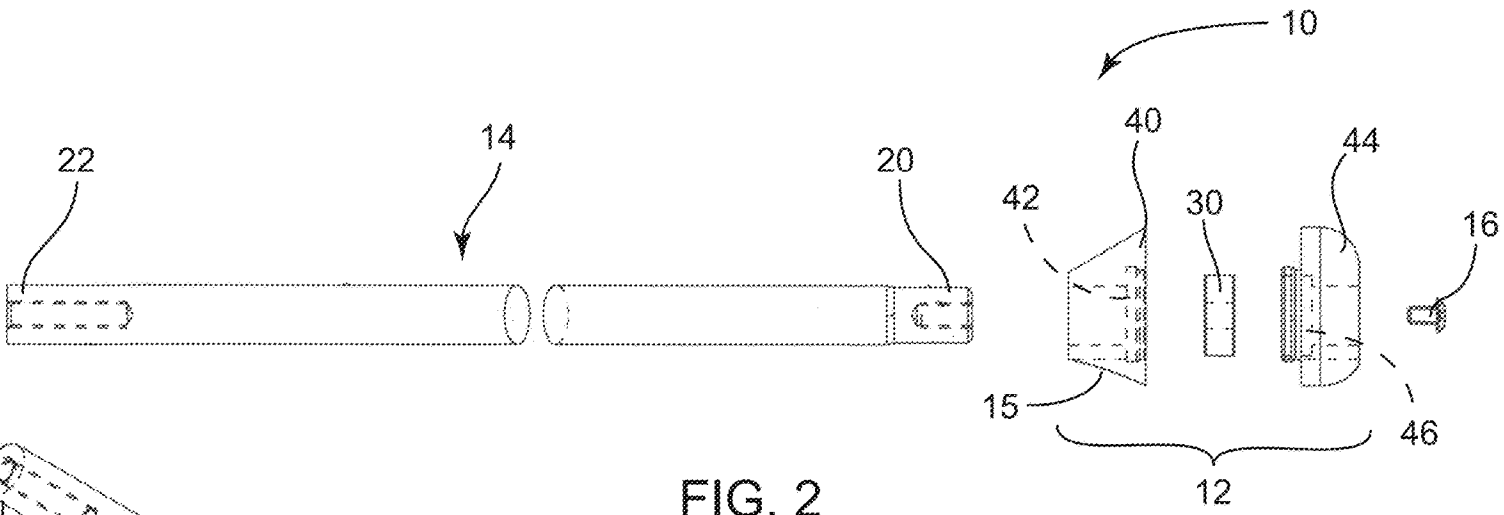
FIG. 2 is side exploded view of the ramrod in accordance with an embodiment.
Figure 3:
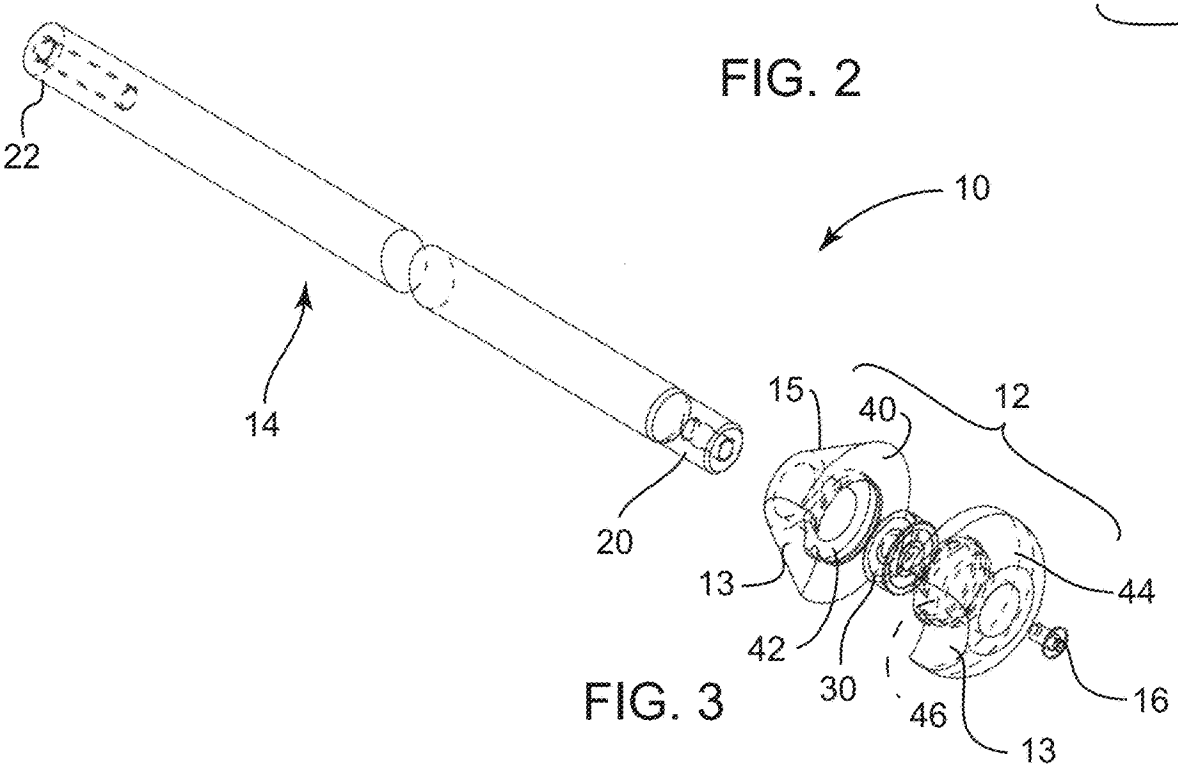
FIG. 3 is a perspective exploded view of the ramrod in accordance with an embodiment.

As shown in FIGS. 1-3, the ramrod 10 may comprise a shaft 14, a knob 12, and a fastener 16. The fastener 16 may be configured to releasably couple the knob 12 to a first end of the shaft 14. The ramrod 10 may be used in association with a jag for cleaning the barrel 19 of a rifle, a weapon 18, such as a rifle or other gun, and a projectile, such as a bullet. The shaft 14 may be configured to be inserted within the barrel 19 of the rifle 18 to thereby force the bullet, the wadding, and the propellant charge, i.e., gunpowder, down the barrel 19 of the rifle 18. Specifically, inserting the shaft 14 into the barrel of the gun allows the ramrod 10 to thereafter be forcefully and repeatedly moved up and down within the barrel of the gun to compact the bullet, wadding, and charge in close proximity to one another within the barrel. When not in use, the ramrod 10 may be stored along the underside of the barrel 19 of the rifle 18, as depicted in FIG. 1.

The shaft 14 may be a straight, cylindrical rod having a diameter at least less than the internal diameter of the barrel 19 of the rifle 18. The shaft 14 may have opposing first end 20 and second end 22. In embodiments of the ramrod 10, the first and second ends 20 and 22 of the shaft 14 may be countersunk and internally threaded to receive a corresponding externally threaded fastener 16, a threaded jag, or other similar component, such as a cleaning jag.

The shaft 14 may be solid for greater integrity and strength or may be hollow for reduced weight. The shaft 14 may be comprised of soft metal that is not anodized, so that the metal does not mar the bore of the rifle 18 when inside the barrel 19 and does not create sparks that might possibly ignite the charge within the barrel. The soft metal material may be T6 aluminum. The shaft 14 may also be configured to have a predetermined length, such that when the shaft 14 is fully inserted within the barrel of the gun up to the knob 12, the bullet, the wadding, and the charge are properly positioned within the barrel. Alternatively, the shaft 14 may be notched, or otherwise marked, to indicate when the shaft 14 has been inserted deep enough into the barrel to properly situate the bullet 20, the wadding, and the charge within the barrel.

As depicted in FIGS. 2-3, the fastener 16 may be utilized to releasably couple the knob 12 to the first end 20 of the shaft 14. The fastener 16 may be inserted completely through a central bore in the knob 12, such that the head of the fastener 16 engages one end of the knob 12, while the threads of the fastener 16 extend beyond the opposing side of the knob 12. Thereafter, the fastener 16 may be threaded into the corresponding internal threads on one of the countersunk distal ends of the shaft 14, thus securing the knob 12 to the shaft 14 by way of the fastener 16.

The knob 12 may further comprise an internal bore 17 that may be placed over the first end 20 of the shaft 14, such that a portion of the shaft 14 slides within the bore 17. Moreover, as depicted in FIGS. 2-3, in embodiments of the knob 12 having the internal bore 17, the fastener 16 may be inserted completely through a central bore in the knob 12, such that the head of the fastener 16 engages one end of the knob 12, while the threads of the fastener 16 extend within the internal bore 17. Thereafter, the fastener 16 may be threaded into the corresponding internal threads on one of the countersunk first end 20 of the shaft 14 that has been inserted into the internal bore 17, thus securing the knob 12 to the shaft 14 by way of the fastener 16 engaging the shaft 14 within the internal bore 17.

Embodiments of the ramrod 10 further comprise an internal bearing 30 positioned within the knob 12 that permit the shaft 14 of the ramrod 10 to rotate within the barrel 19 of the gun 18. Thus, the cleaning jag, the insertion jag, or the like may spin with the shaft 14 within the barrel of the gun 18 in response to cleaning the barrel or in response to inserting the bullet. Specifically, when inserting a bullet within a rifled bore of the barrel 19 of the gun 18, the bullet may grip the rifled portions as it transitions down the barrel and spins within the barrel. To maintain sufficient contact with the bullet, the internal bearing 30 within the knob 12 permits the shaft 14 to also spin so as to maintain direct contact with the bullet. In other words, the knob 12 of the ramrod 10 may further comprise an internal bearing 30 that permits a the shaft 14 and any attached jag to rotate with the bullet as the bullet travels down the barrel so that the bullet does not spin with respect to the shaft 14 or any attached jag and the bullet and the shaft 14 are rotating together at the same rate. In this way, the shaft 14 or any attached jag may remain in better contact with the bullet. Moreover, it is easier to push the bullet down into the proper operating position because the rotating shaft 14 does not have to fight with the bullet as the bullet twists within the barrel, but instead twists with the bullet. As for the cleaning jag, the internal bearing 30 of the knob 12 allow the jag to spin with the shaft 14, as needed, within the barrel in response to forces acting on the jag within the barrel such that the jag does not snag or otherwise get stuck within the barrel as the jag travels up and down the barrel to clean the barrel.

In some embodiments, the knob 12 may include a first portion 40 with a recess 42 and a second portion 44 with a recess 46 and a bore extending through each portion 40 and 44. The recess 42 and the recess 46 are corresponding recesses that allow the internal bearing 30 to be coupled within the recess 42 and the recess 46 as the first portion and the second portion 40 and 44 of the knob 12 are coupled together. For example, the internal bearing 30 may be placed within the recess 42 the first portion 40 of the knob 12, wherein the recess 42 receives a portion of the bearing 30, and the second portion 44 of the knob 12 may be placed over the internal bearing 30 such that the recess 46 of the second portion 44 receives a portion of the internal bearing 30 within the recess 46, such that the internal bearing 30 is completely retained within the recesses 42 and 46. The fastener 16 may then be extended through the bore extending through the second portion 44 and into the first portion 40 and may be coupled to the first end 20 of the shaft 14 inserted within the bore of the first portion 40. The fastener extends through a bore of the internal bearing 30. The internal bearing 30 operates to allow the shaft 14 to rotate with respect to the knob 12.

With continued reference to FIGS. 2-3, the knob 12 may comprise an indentation 13, a tapered leading edge 15, an internal bore 17, and a rounded end 19. As mentioned above, the knob 12 may be coupled to the shaft 14 by means of a fastener 16 or the knob 12 may be directly coupled to the shaft 14. The knob 12 may further comprise a tapered leading edge 15. The edge of the knob 12 that faces the jag 22 may have the tapered leading edge 15, or an outer surface, that tapers from an initial narrow diameter to a widest diameter of the knob 12. The tapered leading edge 15 may be a smooth taper from the initial diameter to the largest diameter so as to prevent the knob 12 from catching, or otherwise snagging, on another surface, structure, or object. In contrast, conventional ramrods placed and stored below the barrel of the gun 18 usually do not have any structure attached to the conventional ramrod, such as a knob or handle, that the user may use to assist the user in gripping the conventional ramrod to maneuver the conventional ramrod to load the muzzleloader. In fact, conventional ramrods stored below the barrel of the gun 18 are usually straight cylindrical rods without any other grip-like structure attached thereto, because to be able to be stored below the barrel of the gun 18, the ramrod must not have anything attached thereto that might interfere with the pre-established interaction between the built-in securing mechanism 9 on the barrel of the gun 18 and the barrel of the gun 18. The securing mechanism 9 may be a latch, clip, loop, or other means that releasably secures the conventional ramrod below the barrel of the gun 18.

Moreover, other conventional ramrods used to load a muzzleloader may have attached thereto a handle or other gripping means, but these conventional ramrods cannot be stored below the barrel of the gun 18 because they interfere with the pre-established interaction between the securing mechanism 9 on the underside of the barrel of the gun and the barrel of the gun. Also, the protruding handle on these conventional ramrods may snag on objects, such as brush, plants, trees, shrubs, etc. as the user moves through the forest or wild terrain with the gun 18. And, once snagged, oftentimes the conventional ramrod will detach from the user without the user being aware, resulting in the user losing the conventional ramrod and possibly being unable to thereafter properly load the muzzleloader.

To overcome the limitations of the conventional ramrod, the tapered leading edge 15 of the knob 12 placed below the barrel of the gun 18 prevents the knob 12 from unsuspectingly catching, or otherwise snagging on foreign objects that might pull the ramrod 10 off of the gun 18. Specifically, if an object comes into contact with the shaft 14 of the ramrod 10 and rides up the shaft 14 to make contact with the knob 12, the object will slide over the tapered leading edge 15 of the knob 12 and off the knob 12 without displacing the ramrod 10 from its stored place under the gun 18. Thus, even as objects brush up against and over the gun 18, the ramrod 10, and the user as the user moves through the brush, forest, or other harsh environment, the ramrod 10 remains in its secured place under the barrel of the gun 18.

Also, the knob 12 may comprise an indentation 13 that runs axially along the length of the knob 12. The indentation 13 may be concave and have an arc radius that is approximate to the arc radius of the external surface of the barrel of the gun 18. In other words, the external arc of the barrel of the gun 18 and the arc of the indentation 13 are comparable. This provides that the ramrod 10 may be stored in the pre-established state under the barrel of the gun 18. Also, when the ramrod 10 is secured to the underside of the gun 18, in its normal pre-established stored state, the indentation 13 engages the external surface of the barrel 19 of the gun 18 and the barrel 19 of the gun 18 rests within the indentation 13. With the indentation 13 engaging the barrel of the gun 18, the ramrod 10 is prevented from shaking, jiggling, rattling, or otherwise moving, with respect to the barrel. This prevents the ramrod 10 from rattling against the barrel and creating unwanted noise. This is particularly important when the user is hunting game and wishes to be as silent and as stealthy as possible so as to not scare away or otherwise alert the mark. Thus, not only does the indentation 13 on the knob 12 allow the ramrod 10 to have a knob 12 attached thereto and still be placed under the barrel of the gun 18 in its pre-established stored state, but it also prevents the ramrod 10 from rattling against the barrel of the gun 18.

While this disclosure has been described in conjunction with the specific embodiments outlined above, it is evident that many alternatives, modifications and variations will be apparent to those skilled in the art, as evident in the attached Appendix, the disclosure of which is incorporated herein in its entirety. The preferred embodiments of the present disclosure as set forth above are thus intended to be illustrative, not limiting. Various changes may be made without departing from the spirit and scope of the present disclosure, as required by the following claims. The claims provide the scope of the coverage of the present disclosure and should not be limited to the specific examples provided herein.

The invention claimed is:

1. A ramrod for a muzzleloader, the ramrod comprising:
a shaft having a first end and a second end; and
a knob releasably and rotatably coupled to the first end of the shaft, the knob comprising:
a first portion, comprising:
a first recess;
a second portion coupled to the first portion, the second portion comprising:
a second recess, wherein a bore extends through each of the first portion and the second portion;
an internal race bearing, wherein the first recess corresponds to the second recess to couple a portion of the internal bearing within the first recess and couple the remainder of the internal bearing within the second recess, wherein the shaft engages an inner ring of the race bearing and the first and second portions engage an outer ring of the race bearing, wherein the shaft rotates with respect to the knob by operation of the internal bearing in response to rotation of a bullet during loading a rifle with the bullet, wadding, and a propellant charge; and
a threaded fastener that extends through the bore extending through the first portion and the second portion and engages a corresponding threaded recess in the first end of the shaft.

2. The ramrod of claim 1, wherein the first end of the shaft is inserted within the bore of the first portion.

3. The ramrod of claim 1, wherein the knob further comprises a tapered leading edge.

4. The ramrod of claim 1, wherein the knob further comprises an indentation extending axially along the length of the knob.

5. The ramrod of claim 4, wherein the indentation is concave and has an arc radius that is approximate to the arc radius of an external surface of the barrel of the gun.

6. The ramrod of claim 5, wherein the ramrod in a stored state comprises the indentation engaging the external surface of a barrel of the gun.

7. The ramrod of claim 6, wherein the indentation engaging the barrel of the gun prevents the ramrod from shaking, jiggling, rattling, or otherwise moving, with respect to the barrel.

* * * * *